United States Patent [19]

Renfroe et al.

[11] Patent Number: 4,492,401

[45] Date of Patent: Jan. 8, 1985

[54] NON-MARRING LIFTING CLAMP

[75] Inventors: Charles J. Renfroe; William Davies, both of Jacksonville, Fla.

[73] Assignee: J. C. Renfroe and Sons, Inc., Jacksonville, Fla.

[21] Appl. No.: 504,313

[22] Filed: Jun. 14, 1983

[51] Int. Cl.[3] ..... B66C 1/48

[52] U.S. Cl. ..... 294/101; 294/104

[58] Field of Search ..... 294/101, 102 R, 103 R, 294/104, DIG. 1; 116/208, 327–329, 335

[56] References Cited

U.S. PATENT DOCUMENTS

| | | | |
|---|---|---|---|
| 2,852,300 | 9/1958 | Gardner | 294/104 |
| 2,986,422 | 5/1961 | Renfroe . | |
| 3,120,046 | 2/1964 | Olsen . | |
| 3,257,143 | 6/1966 | Wansley . | |
| 3,297,354 | 1/1967 | Renfroe | 294/104 |
| 3,300,242 | 1/1967 | Renfroe | 294/101 |
| 3,441,308 | 4/1969 | Gardner . | |
| 3,507,534 | 4/1970 | Gardner . | |
| 3,659,890 | 5/1972 | Renfroe | 294/101 X |
| 3,773,377 | 11/1973 | Kopp | 294/101 X |
| 3,843,186 | 10/1974 | van de Wetering . | |
| 3,851,358 | 12/1974 | Janosko . | |
| 3,857,600 | 12/1974 | Hasegawa | 294/104 |
| 3,960,264 | 6/1976 | Carbine . | |
| 4,113,298 | 9/1978 | Kopp . | |
| 4,273,373 | 6/1981 | van de Wetering . | |

*Primary Examiner*—Johnny D. Cherry

*Attorney, Agent, or Firm*—Banner, Birch, McKie & Beckett

[57] ABSTRACT

A non-marring lifting clamp for articles such as metal plates has a pair of opposed jaws mounted on opposite sides of a slot formed in the side plates of the clamp body with one of the jaws being pivotally mounted for opening and closing movements relative to the other jaw, and a lifting shackle being mounted for guided movement in the clamp body. A linkage assembly in the body couples the shackle to the pivotally mounted gripping jaw to urge the gripping jaw toward the other jaw when a lifting force is applied to the shackle. The linkage assembly includes a swing link connected to move the gripping jaw and a control link pivoted to the clamp body with a connecting mechanism coupling the control link both to the shackle and to the swing link. A manually operated pivotally mounted handle accessible exteriorly of the clamp body operates a locking mechanism which includes a coil spring associated with the control link, this spring acting on such control link and being tensioned or released by operation of the handle. The locking mechanism includes a cam link mechanism connected to be shifted by handle movements, the cam link mechanism cooperating through the coil spring with the control link to bias the control link alternately to the jaw closing position or jaw open position. The cam link means also provides a limiting stop acting on the control link to retain it alternately in jaw open position or jaw closing position while still allowing limited opening movement of the jaws by overcoming the biasing force of the tensioned coil spring. The lifting clamp further has the other jaw carried on a manually adjustable wedge with visually observable indicia associated with this other jaw and also with the gripping jaw for the operator to visually determine the clamp's suitability in handling a particular size plate to be lifted.

14 Claims, 8 Drawing Figures

NON-MARRING LIFTING CLAMP

BACKGROUND OF THE INVENTION

This invention relates to clamps for lifting articles, such as metal plates, and more particularly to such a clamp wherein the opposed jaws have flat surfaces and are moved together to grip the article to be lifted in such a manner that articles lifted will not have their surfaces seriously damaged incident to the lifting by the clamp.

Further, the lifting clamp of the invention relates to clamps having a locking device to retain the clamp jaws in either an open or closed position.

Renfroe U.S. Pat. No. 2,654,630 exemplifies this latter type of clamp, as does Davies U.S. Pat. No. 4,162,804, the latter patent disclosing an auxiliary lock means to latch the primary locking device against inadvertant movement which could release the clamp to its open position.

Basically, the two above-identified patents disclose clamps having a clamp body with a slot to receive an article to be lifted. A jaw is provided on each side of this slot adjacent the outer open end of the slot. The gripping jaw is movable between open and closed positions relative to the other jaw which is usually fixed. The movable jaw is operated by a shackle connected to the movable jaw by a linkage assembly which characteristically provides force multiplying action in transmitting lifting force between the shackle into clamping force applied to the opposed jaws.

The lifting clamp body includes a pair of spaced side plates with a pivotal locking plate mounted on the inside of the side plates, this locking plate being operated by a handle exposed exteriorally of the clamp body. A heavy tension spring connects the locking plate to the linkage assembly which extends between the shackle and the movable jaw. By rotation of the locking handle to a closed position, the spring exerts a heavy closing force on the movable jaw.

Characteristic of the lifting clamps exemplified by the above-mentioned patents is the fact that the movable jaw is pivotally mounted so that it necessarily swings through an arc into gripping engagement with the surface of the article to be lifted. It also is common practice for this movable jaw, and indeed the opposed stationary jaw, to be provided with gripping teeth which will dig into the surface of the lifted article. While such swinging action of the movable jaw and the provision of gripping teeth on the jaw are advantageous in lifting articles made of steel, there are instances where articles made of materials such as bronze, stainless steel or polished smooth surfaces would be unduly marred or gouged by the swing-in action of a pivoted movable jaw carrying gripping teeth on its clamping surface.

There also are drawbacks in prior art lifting clamps like those of the above-mentioned patents in that the spacing between the opposed jaws of the clamp is not adjustable other than incident swinging in movement of the pivotal jaw of the clamp.

Additionally, the manually engagable lock handle on such lifting clamps frequently must be so located that its swing path extends substantially beyond the perimeter of the clamp body. Thus, when the handle must be shifted between its extremes to effect either the jaw opening or closing operations, this handle projection beyond the clamp body perimeter can be obstructed by closely adjacent items in the environment where the clamp is being used.

Again, in referring to the locking devices associated with prior art lifting clamps, these frequently require full swing manual operation of the handle between its extreme positions either to move the lock handle fully to a locked open position or fully to a locked closed position. In contrast, it can be advantageous to permit the lock device handle to be moved to a neutral position, a position which will not urge opening of the lifting clamp but will only permit the jaws to open when the lifting force is relaxed. Thereafter, as long as the clamp is in a vertical position, the weight of the shackle and remaining biasing force of the spring will automatically move the lock handle from the neutral position to its fully locked open position.

Finally, prior so-called non-marring clamps which incorporate a single throw locking device, are generally bulky and unwieldy for their intended lifting applications. They frequently contain numerous and complicated mechanisms and necessarily end up being very expensive.

SUMMARY OF THE INVENTION

Generally, the invention relates to a lifting clamp which comprises a clamp body including a pair of spaced side plates. The body defines a slot through the side plates to receive an article to be lifted. A pair of opposed jaws are mounted on opposite sides of this slot with one of the jaws being pivotally mounted for opening and closing movements relative to the other jaw, which is adjustable, and a lifting shackle is mounted for guided movement in the clamp body. A linkage assembly in the body couples the shackle to the pivotally mounted gripping jaw to urge this jaw toward the other jaw when lifting force is applied to the shackle. The linkage assembly includes a swing link connected to move the gripping jaw and a control link pivoted to the clamp body with connecting means coupling the control link both to the shackle and to the swing link.

A manually operated pivotally mounted handle accessible exteriorally of the clamp body operates a locking means which includes a coil spring associated with the control link, this spring acting on such control link and being tensioned or released by operation of the handle. The locking means includes cam link means connected to be shifted by handle movements with this cam link means cooperating, by way of the coil spring, with the control link to bias such link alternately to the jaw closing position or jaw opening position. The cam link means also provides a limiting stop acting on the control link to retain it alternately in jaw open position or jaw closing position. Nonetheless the control link-cam link relationship allows, in jaw closing position, limited opening movement of the jaws by overcoming the biasing force of the tensioned coil spring.

The lifting clamp further has the other jaw opposed to the gripping jaw carried on a manually adjustable wedge with visually observable indicia associated with this other jaw. Visually observable indicia are also associated with the gripping jaw. These visually observable indicia enable the operator to visually determine the clamp's suitability for handling a particular size plate to be lifted as well as determine possible wear of parts within the clamp through heavy usage which might render the clamp dangerous for continued use.

A principal object of the present invention is to provide an improved non-marring lifting clamp suitable for gripping smooth surfaces without gouging or marring, and for lifting articles made of materials such as bronze, stainless steel, or polished steel surfaces.

A primary object of the invention is to provide a lifting clamp incorporating an overcenter type locking device where the lock handle is movable to a neutral position while the clamp is subjected to lifting loads and wherein the lock handle automatically thereafter moves to a full locked open position when the lifting force is relaxed.

A further important object of the invention is to provide a lifting clamp wherein the lock handle for the locking device is shiftable between its extreme lock open and lock closed positions by handle movement fully within the parameter of the clamp body.

Another object of this invention is to provide a lifting clamp having an adjustable wedge carrying one clamp jaw provided with plate thickness indicator means such that the jaw spacing to accommodate a particular size article to be lifted can be manually set prior to installing the clamp on the article.

A further important object of the invention is the provision of a lifting clamp wherein the movable jaw is permitted to undergo limited opening movement against the biasing force of the lock mechanism but thereafter positively stopped against further opening movement.

Other advantages of this invention will become apparent from the following disclosure taken in connection with the accompanying drawings wherein a preferred construction of an embodiment of the invention is set forth by way of example.

BREIF DESCRIPTION OF THE DRAWINGS

DESCRIPTION OF A PREFERRED EMBODIMENT

Figure 1:
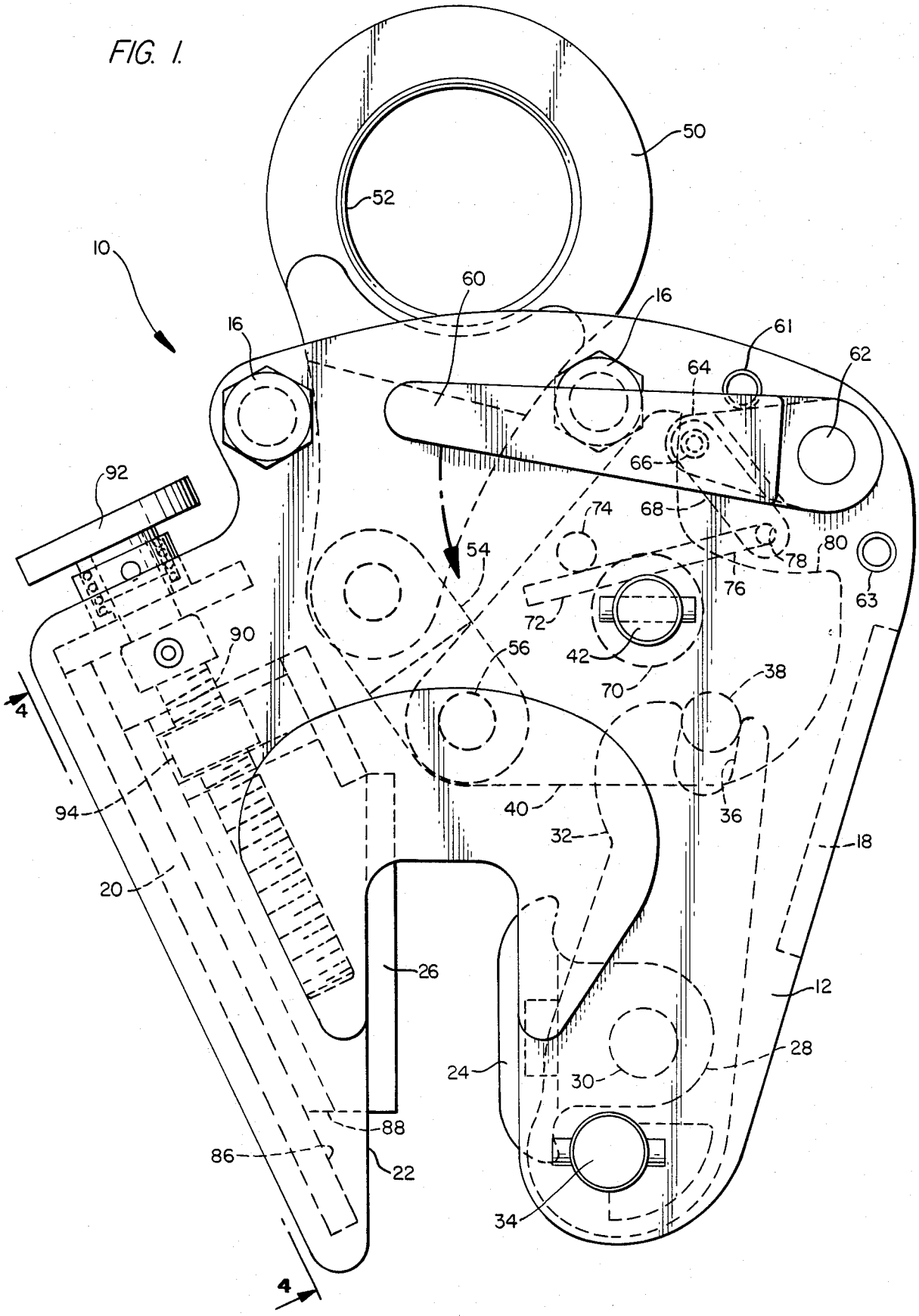
FIG. 1 is an elevational view showing the lifting clamp of the invention with the manually operated locking device handle in jaw open position.
Figure 2:
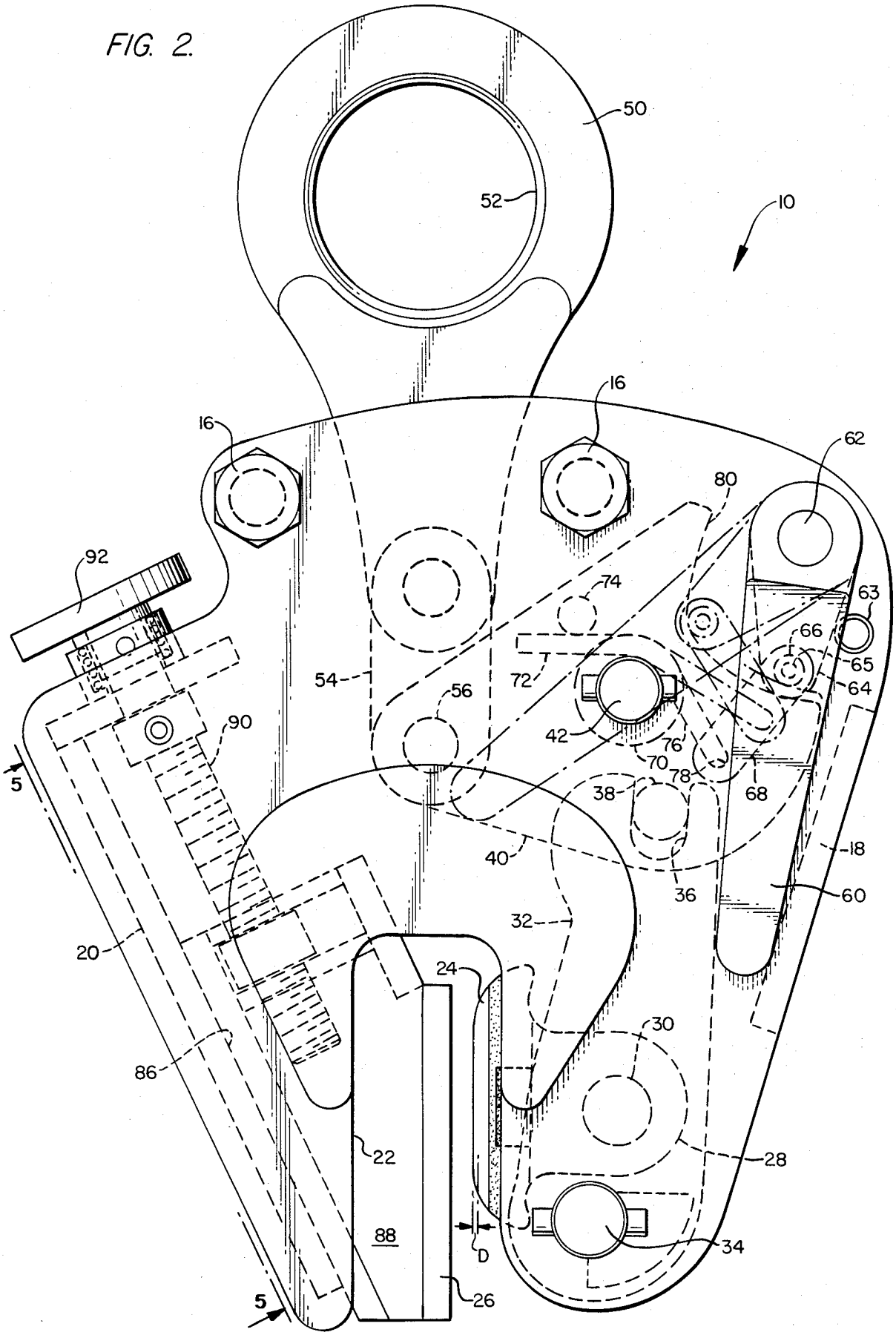
FIG. 2 is a view similar to FIG. 1, but showing the handle in jaw closing position and, in phantom lines, in a neutral position.

As shown on FIG. 1, lifting clamp 10 has its locking mechanism disposed in jaw open position. In FIG. 2 the clamp 10 is shown with this locking mechanism in jaw closed position although the phantom line showing on FIG. 2 additionally illustrates the neutral position for such locking mechanism.

Clamp 10 is primarily designed to handle finished stainless steel, copper, aluminum and other polished plates, thus the gripping surfaces of the opposed jaws are flat, reducing the possibility of marring soft metal material making up the article being lifted. In use, the lifting clamp 10 is capable of turning a single plate or member from horizontal to vertical and back to horizontal through a 180° arc.

Figure 3:
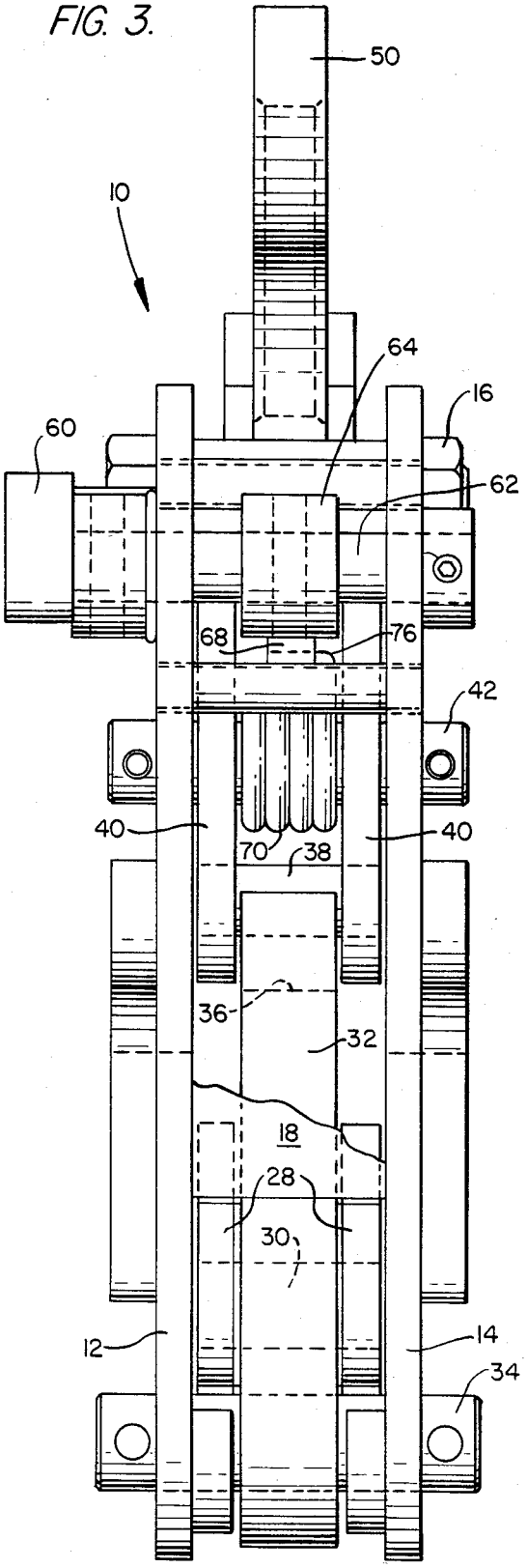
FIG. 3 is a side elevational view of the clamp as shown on FIG. 1 with bridging member 18 broken away.
Figure 4:
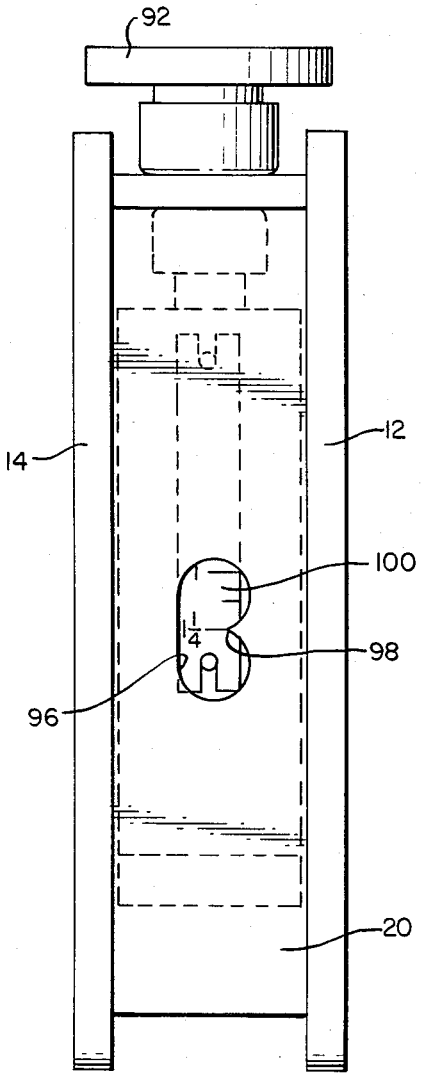
FIG. 4 is an elevational view taken on line 4—4 of FIG. 1.
Figure 5:
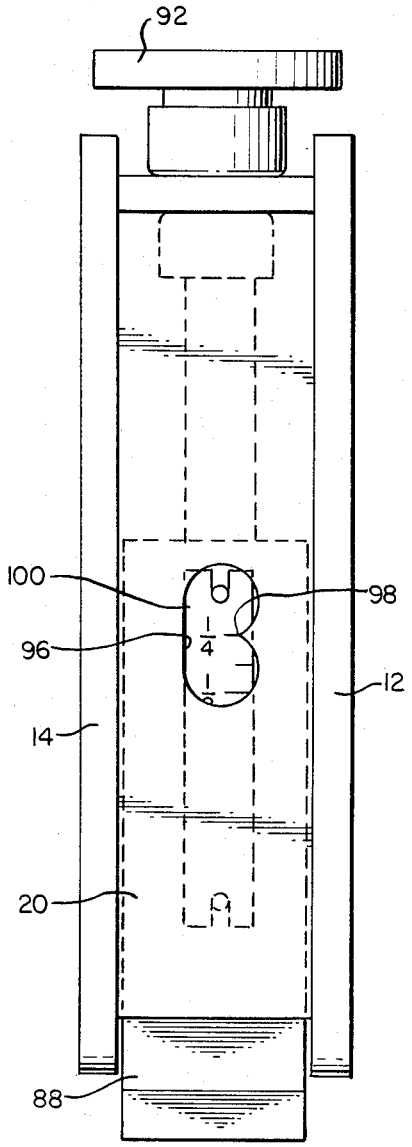
FIG. 5 is an elevational view taken on line 5—5 of FIG. 2.

The body of clamp 10 is made up of two side plates 12 and 14, these being best seen in FIGS. 3–5. This pair of side plates 12 and 14 is secured in spaced relation to each other by bolts 16 provided with spacer tubes encircling the bolts between the plates 12 and 14. Also, bridging members 18 and 20 are provided, these being welded to the insides of the side plates 12 and 14 to rigidly hold the lower ends of the clamp side plates in appropriate spaced relation. Generally, these techniques for assembling side plates into a lifting clamp body are conventional and need not be described in further detail.

Side plates 12 and 14 have a slot 22 formed therein, this slot in the lifting clamp body serving to receive an article to be lifted. A pair of opposed jaws 24 and 26 are mounted on opposite sides of the clamp body slot 22. In lifting clamp 10, this pair of opposed jaws consists of a gripping jaw 24 and an adjustable jaw 26. Jaws 24 and 26 are mounted in a manner as will be explained for opening and closing movements relative to each other to clamp an article to be lifted when inserted between the jaws in the lifting clamp body slot 22. Both of the opposed gripping surfaces of jaws 24 and 26 are flat, thereby reducing the possibility of marring soft metal articles being lifted by lifting clamp 10.

The gripping jaw 24 is provided with a pair of spaced parallel mounting ears 28 (FIG. 39 which extend rearwardly from the flat gripping surface of this jaw. Ears 28 have aligned apertures which are engaged by a mounting pin 30 by means of which the gripping jaw 24 is pivotally mounted to be properly located at one side of the slot 22 in the body of lifting clamp 10.

Mounting pin 30 extends through an aperture in a swing link 32 so that pin 30 effectively pivotally supports the gripping jaw 24 intermediate the ends of swing link 32. Links 32 is pivoted to the clamp body adjacent one end by mounting pin 34 passing through aligned apertures in the side plates 12 and 14 of such body and through a bore formed near the end of swing link 32.

The opposite end of swing link 32 is provided with a longitudinally extending slot 36. Slot 36 is engaged by a control pin 38 which in turn is carried by the spaced parallel plates (FIG. 3) making up the control link 40. The plates of control link 40 are pivotally mounted between the side plates 12 and 14 on pin 42, which extends through these side plates forming the body of lifting clamp 10.

Lifting clamp 10 is provided with a shackle 50 having a large opening 52 that is adapted to receive a conventional lifting hook at the end of a hoisting cable. Shackle 50 extends down into the body of lifting clamp 10, between side plates 12 and 14, with the shackle end located within the clamp body being pivotally pinned to one end of a coupling link 54. The opposite end of coupling link 54 is pivotally connected to the control link 40 by means of pin 56, pin 56 extending between the plates of control link 40 and through an end bore in coupling link 54.

The interposition of coupling link 54 between the end of shackle 50 and transmission of lifting force to the control link 40 through pin 56 provides added flexibility for manipulating shackle 50 in utilization of lifting clamp 10. It also facilitates utilizing a shackle 50 with a bifurcated end where it is pivotally connected to coupling link 54. It will be understood, however, that other structural approaches might be adopted in transmitting the lifting force from a shackle such as 50 to the appropriate location on the control link 40 that is pivotally mounted on pin 42 between the clamp body side plates 12 and 14.

From the structure of lifting clamp 10 described hereinabove, the manner in which lifting forces applied to shackle 50 operate the clamp will be readily understood. Upward lifting forces applied to the shackle will tend to pivot control link 40 clockwise about pin 42 in the relationship of the parts as shown on FIG. 2. This clockwise pivoting of control link 40 will move control pin 38 clockwise relative to the axis of mounting pin 42 and by its engagement in slot 36 at the end of swing link 32, the swing link will be urged counterclockwise about the axis of its mounting pin 34. Thereby, gripping jaw 24 pivotally mounted by ears 28 on pin 30 that is engaged with swing link 32 will be transposed inwardly toward gripping relation to an article disposed between the opposed jaws 24 and 26 located within the clamp body slot 22.

It follows that relaxation of application of lifting forces to shackle 50 will tend to relax the above-described parts into the relationship of the lifting clamp 10 shown on FIG. 1. This lifting force relaxation, absent the locking mechanism described in detail hereinafter, will retract the gripping jaw 24 into the jaw open position as shown on FIG. 1.

Thus, a linkage assembly coupling shackle 50 to control movements of gripping jaw 24 is effectively formed between the shackle and the gripping jaw. This linkage assembly is made up of swing link 32 connected to move gripping jaw 24 and control link 40 pivoted to the side plates 12 and 14 of the clamp body with a first connecting means provided by coupling link 54 acting to couple the shackle to the control link 40 and a second connecting means provided by control pin 38 engaging in slot 36 on swing link 32 acting to couple the control link to this swing link.

The locking mechanism acting in association with the control link 40 will now be described in detail.

A manually operated handle 60 accessible exteriorally of the body of lifting clamp 10 is pivotally mounted on such body by shaft 62 which extends through the side plates 12 and 14 and to which the handle 60 is fixedly secured. Whereas the particular embodiment illustrated on the drawings shows a single manually operated handle 60 secured to one end of shaft 62, for convenience to the clamp operator in attaching and removing the lifting clamp 10 from a plate or other article to be lifted two such manually operated handles may be provided, one at each of the ends of shaft 62. Of course, then the two handles 60 would be exposed exteriorally on opposite sides of the clamp side plates 12 and 14 to be readily accessible to the clamp operator.

Shaft 62 which is pivoted by the swinging or shifting movements of handle 60 has an arm 64 mounted between the inner faces of side plates 12 and 14 that make up the clamp body. Arm 64 is suitably pinned to shaft 62 so that it moves with shaft 62 as handle 60 is manually shifted between jaw open and jaw closing positions in clamp operation. Stop pins 61 and 63 fixed between side plates 12 and 14 are engaged by arm 64 at the opposite ends of its pivotal movement at the jaw open and jaw closed positions.

The end of arm 64, distal from shaft 62 to which the arm is fixed pivotally supports by pin 65 a compression link 68 which is connected with spring means that is also associated with control link 40, as will be explained. Mounted on the ends of pin 65 are rollers which function as cam follower means 66, such means engaging cam surfaces on the control link 40 as will be described.

The arm 64 together with the cam follower means 66 and compression link 68 both of which are pivotally supported on the outer end of such arm form a cam link means which is controlled by swinging or shifting movements of the manually operated handle 60 fixed to pivot shaft 62. As shifted by swinging movements of handle 60, this cam link means cooperates with the linkage assembly described hereinabove through spring means associated with the control link to bias this linkage assembly either to its jaw closing position such as depicted in FIG. 2 or to release this assembly to its jaw open position such as depicted in FIG. 1.

To cooperate with the components of the above-described cam link means, a coil spring 70 is mounted to encircle pivot pin 42 so as to be coaxial with the pivotal mounting of the control link 40. One of the spring ends 72 extending tangentially from coil spring 70 is constrained to pivot with control link 40 by a pin 74 extending between and carried by the parallel plates making up control link 40. The other tangentially extending end 76 of coil spring 70 has its terminal portion bent at right angles to pass into an aperture 78 formed in the end of compression link 68. Through this connection between spring end 76 engaging in aperture 78 of compression link 68, movements of link 68 through its connection to arm 64 pinned to shaft 62 carrying handle 60 act to tension and release the coil spring 70.

Reference may now be made to the construction of control link 40 to provide the needed cam surface with which the cam follower means 66 on the distal end of arm 64 engages in the functioning of the locking mechanism that is actuated under control of handle 60.

The spaced parallel plates making up the control link 40 each have a contoured cam surface 80 formed on a peripheral segment thereof. This cam surface has a generally U-shaped contour and faces outwardly of the pivotal mounting for control link 40 provided by pin 42. The cam follower means 66 on the distal end of arm 64 engages with this cam surface 80. Thus, depending on the point of interengagement between cam follower means 66 and cam surface 80 the control link 40 is retained by means 66 on arm 64. At one operating extreme of the shifting movement of handle 60, shown on FIG. 1, link 40 is positively retained in jaw open position.

However, the contour of cam surface 80 relative to the radial distance of cam follower means 66 from the pivot axis of shaft 62 is configured such that a limited opening movement of the jaws from their normal jaw closing position is allowed in the other extreme of shifting movement of handle 60 as is shown on FIG. 2.

Referring to FIG. 2, it will be seen that cam follower means 66 is spaced slightly from the cam surface 80 in the particular orientation of shaft 62 for the position of arm 64 and handle 60 shown on this Figure. This slight spacing between cam follower means 66 and cam surface 80 permits the control link 40 to pivot slightly counterclockwise before the cam surface physically engages cam follower means 66. Beyond this, further pivoting of control link 40 is positively prevented. This slight movement, transmitted through control pin 38 and slot 36 on swing link 32, will allow a backup of gripping jaw 24 in the order of the distance D shown on FIG. 2.

The need for this slight backup may be explained as follows. It has been noted in lifting clamp operations that generally a slight backup such as represented by the distance D which may not be more than 1/16 inch will occur when a lifting clamp is turning a particularly long plate from a horizontal disposition to vertical. This turning of the long plate tends to pry the gripping jaw toward an open position.

However, it is to be kept in mind that during this minimal backup of distance D the maximum biasing force of spring 70 is being applied to restrain the control link 40 against any counterclockwise movement of the link. In other words, even the slightest movement of control link 40 and swing link 32 which carries gripping jaw 24 can only occur by overcoming the strong biasing force of the tensioned coil spring 70.

Referring further to the biasing action of coil spring 70 in operation of the locking means on control link 40, reference will be made to the action of compression link 68 which is pinned to the distal end of arm 64 on shaft 62 and therefore under control of shifting movements of handle 60. This compression link 68 is connected by its aperture 78 to the terminal portion of one of the tangentially extending ends 76 of coil spring 70. The other tangential end 72 of such spring abuts the pin 74 carried by the plates of control link 40.

In the position of the parts of the locking mechanism acting on control link 40 as shown in FIG. 1, the tension on the tangentially extending ends 72 and 76 of coil spring 70 may be considered as essentially released or relaxed. At the minimum, the spring tension between spring end 72 abutting pin 74 on control link 40 and spring end 76 connected at aperture 78 to compression link 68 will be sufficient to hold control link 40 in its position shown and also hold handle 60 through shaft 62 and arm 64 connected to compression link 68 in the open jaw position with arm 64 engaging stop pin 61.

As handle 60 is shifted or swung to the solid line position shown on FIG. 2, the simultaneous movement of arm 64 with shaft 62 will act through compression link 68 to progressively tension coil spring 70 until handle 60 reaches the position where the pivot pin 65 is centered in alignment between shaft 62 and aperture 78. Further movement of the handle to move the pivot pin 65 past the centered alignment described causes the spring 70 to bias the handle toward the extreme shifted position where the clamp jaws are in jaw closing position. At that position the arm 64 rests against stop pin 63. With spring 70 tensioned as shown in FIG. 2, spring end 72 acting through pin 74 is strongly biasing control link 40 in a clockwise direction about its mounting pin 42, thus likewise biasing gripping jaw 24 toward adjustable jaw 26 to grip any article between the jaws that is to be lifted by clamp 10.

It will, of course, be realized that in addition to the biasing forces applied by the coil spring 70, the interengagement between cam surface 80 and cam follower means 66 on arm 64 pinned to shaft 62 will also compel movement of control link 40 in accordance with the contour of cam surface 80.

Still referring to FIG. 2, there is shown thereon an intermediate or neutral position for the manually operated handle 60. In this position, located generally midway between the solid line position for handle 60 shown on FIG. 2 and the position for handle 60 shown on FIG. 1, the cam follower means 66 lies near the mid portion or crotch of the generally U-shaped contour of cam surface 80. Additionally, the tension as between the tangential ends 72 and 76 of coil spring 70 has been somewhat diminished consequent to movements of compression link 68 along with the swing of arm 64 as handle 60 pivots shaft 62.

The handle 60 may be manually moved to the neutral position from the locked closed position when the clamp bears a load with the cam follower means 66 in its normal slightly spaced position from the cam surface 80. In such locked closed position the handle 60 may be manually moved clockwise as shown in FIG. 2 until the cam follower means 66 engages cam surface 80 at the neutral position as shown in phantom in FIG. 2. Further manual movement of the handle is prevented by the force of the load hanging from the clamp's jaws which resists any counterclockwise movement of the control link 40. The curve of the cam surface 80 relative to the radius of the arc along which the cam follower means 66 moves is such that the cam follower means engages the cam surface after the pivot pin 65 passes from the lock closed position back across its centered position so that the spring 70 biases the handle 60 to the neutral position.

With the neutral position for handle 60 as shown in phantom lines on FIG. 2, the lifted plate suspended from clamp 10 may be retained fully gripped between jaws 24 and 26 by shifting the handle 60 to this neutral position. The lifting force remains applied through shackle 50. However, with the cam follower means 66 located in the crotch of the U-shaped cam surface 80 and slight relaxation of the tension in coil spring 70 having occurred through movement of compression links 68, clamp 10 will be conditioned so that the plate held within the clamp is not released until such time as the plate is lowered and lifting force relieved from application to shackle 50.

When this latter event occurs, the weight of shackle 50 pressing down through coupling link 54 on pin 56 carried by control link 40 together with the reduced tension between the tangential ends 72 and 76 of coil spring 70 will enable the remaining tension in the coil spring to press upwardly through compression link 68 against the end of arm 64 urging it up along cam surface 80 to pivot shaft 62 and carry lock handle 60 to its extreme locked open position such as shown in FIG. 1.

Thus, with lifting clamp 10 having handle 60 shifted to its neutral position as shown in phantom lines on FIG. 2, by merely relaxing the lifting force applied through shackle 50 the locking mechanism will automatically move the handle to the open jaw position for clamp 10 without the necessity of intervention by the operator after he has set the handle 60 in such neutral position.

The overcenter linkage provided by the arm 64 and the compression link 68 is effective in three situations. As described when the handle 60 is moved from the locked open position to the locked closed position, the passage of pin 65 past its centered position aligned between shaft 62 and aperture 78, causes the spring 70 to bias the linkage to the locked closed position. In that position, when a force on the jaw 24 causes such jaw to backup the distance D, the cam surface 80 exerts a force on the cam follower means 66. Such force tends to tighten the engagement of the arm 64 with the pin 63 due to the overcenter linkage. Finally, when the handle 60 is moved from the locked open position toward the neutral position, the passage of the pin 65 past its centered or aligned position causes the spring 70 to bias the linkage to the neutral position.

Significantly, the handle 60 remains within the confines of the clamp body throughout its travel. It is also advantageous that the handle 60 is moved downwardly to the locked closed position thereby tending to push the clamp down into proper position relative to the plate to be lifted.

Reference will now be made to the adjustability features of jaw 26 that is disposed on the opposite side of slot 22 in the clamp body of lifting clamping 10, opposed to the gripping jaw 24.

The bridging member 20 that is welded between the inner faces of side plates 12 and 14 to form part of the clamp body provides an inclined guide track 86. Jaw 26 is carried by a wedge shaped carriage 88 which is slidable along the inclined guide track 86. A screw 90 provided with an adjusting knob 92 is supported on the clamp body between side plates 12 and 14 by appropriate means to restrain it from axial movement relative to the clamp body. Screw 90 is threaded into an internally threaded sleeve 94 retained on the wedge shaped carriage 88.

Thus, by manually adjusting screw 90 by means of knob 92, the wedge shaped carriage 88 and in turn jaw 26 carried thereby may be appropriately adjusted along the guide track 86 so that the spacing between jaws 24 and 26 in the jaw closing position for lifting clamp 10 can be adjusted as desired to accommodate the particular size plate to be lifted.

Referring to FIGS. 4 and 5, an important feature of the invention is in providing the clamp operator with visually observable indicia associated with the manually adjustable jaw 26 so that the operator can properly adjust the clamp to handle the particular size plate that is to be lifted. This size adjustment of the clamp is particularly important in a clamp such as involved herein where only limited relative movement between the clamping jaws 24 and 26, both having flat non-marring surfaces, is contemplated in clamp operation.

As shown on FIG. 4, the bridging member 20 has an observation window 96 formed therein, opening through the guide track 86 which supports the wedge shaped carriage 88 that mounts jaw 26. This observation window 96 may have an indicating pointer 98 to facilitate observing its relative position on a scale 100, such scale being mounted on the wedge shaped carriage 88 that carries the jaw 26.

From FIGS. 4 and 5, it will be seen that scale 100 will carry plate size identifying markings. For a lifting clamp 10, contemplated to be usable for lifting plates ranging in thickness from $\frac{1}{4}$ inch to $1\frac{1}{4}$ inches, the markings on scale 100 might be as shown on FIGS. 4 and 5. With these markings as a guide, the operator utilizing the clamp for plate lifting purposes will initially adjust the spacing between jaws 24 and 26 by manually turning adjusting knob 92 until the appropriate plate thickness marking on scale 100 is aligned with pointer 98 of observation window 96. The operator may then be assured that the clamp is properly adjusted for the particular plate size that he intends clamp 10 to handle.

Figure 6:
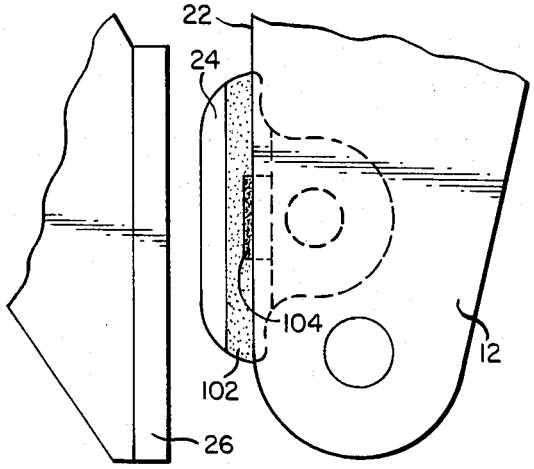
FIG. 6 is a partial elevational view of the clamp jaws in closed condition without an article to be lifted therebetween.
Figure 7:
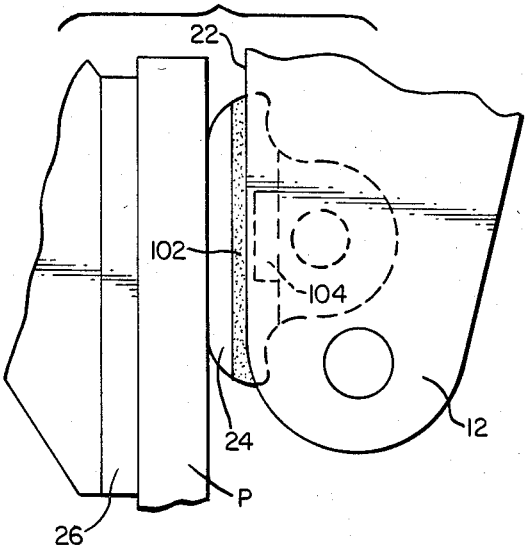
FIG. 7 is a view similar to FIG. 6, but with an article to be lifted between the jaws exposing the warning indicia on the pivotally mounted jaw.

A further feature of the invention resides in providing gripping jaw 24 with visually observable indicia applied to a surface of the gripping jaw. This feature may best be understood by reference to FIGS. 6—8.

One or preferably both side edges of gripping jaw 24 will be provided with two contrasting markings forming the visually observable indicia. These contrasting markings might be a red colored area 102 and a green colored area 104. Of course, the particular size or shape of these particular areas is unimportant, but their spacial relationship rearwardly from the flat gripping face of jaw 24 and relative to the edge of slot 22 needs to be explained.

The visually observable indicia formed by the contrasting markings of areas 102 and 104 are to be located such that both areas are exposed when the gripping jaw 24 is in jaw closing position in the absence of a plate to be lifted being disposed between the opposed jaws 24 and 26 and with the jaws spaced apart. An operator visually observing the marking in area 104 which might be green incident moving the locking handle 60 to jaw closing position without a plate to be lifted disposed between the jaws would be apprised that the jaw moving linkage is in condition for gripping a plate.

Then, with a plate P that is to be lifted disposed between jaws 24 and 26, if the operator notes remaining exposure of some portion of area 102 when he moves the lock handle 60 to jaw closing position, he is immediately apprised that either lifting clamp 10 is not adjusted by way of adjustable jaw 26 to the proper thickness of the plate disposed between the jaws or that the lifting clamp, through usage or other causes, is in need of maintenance. This might be a condition shown for the areas 102 on FIG. 7.

Figure 8:
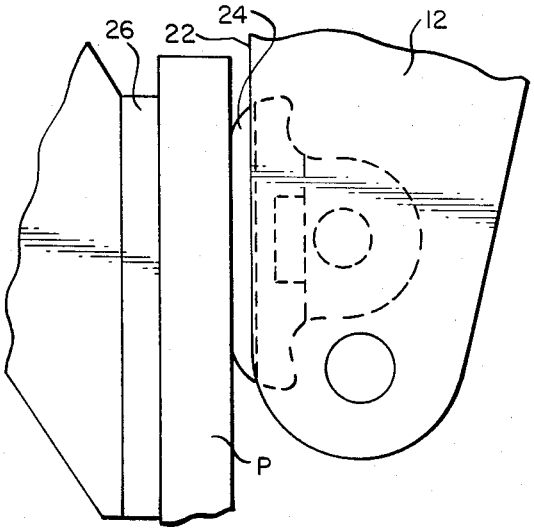
FIG. 8 is a partial elevational view of the clamp jaws when properly adjusted to handle the article to be lifted.

Finally, if the operator has adjusted jaw 26 by manually turning knob 92 and matching the scale markings on scale 100 with pointer 98 in observation window 96 and plate P is disposed as shown in FIG. 8, with the clamp operated to jaw closing position, both of the contrasting markings in areas 102 and 104 should be concealed behind the edge of slot 22 in the lifting clamp body. In this latter event, the operator is immediately apprised that lifting clamp 10 is set at the proper thickness of the plate to be lifted and that the clamp itself is capable of gripping a plate.

A preferred embodiment of the invention has been illustrated and described. It will be understood, however, that various modifications may be made by persons skilled in the art without departing from the scope of the invention as defined by the appended claims.

We claim:

1. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link carrying said gripping jaw and connected to move said gripping jaw through said opening and closing movements, and a control link pivoted to said side plates with first and second connecting means coupling said control link to said shackle and to said swing link, respectively; and locking means having a manually operated handle pivotally mounted on said clamp body and spring means between said side plates connected to act on said linkage assembly, said spring means having one end constrained to pivot with said control link and the other spring end connected to a cam link means whereby said spring means is tensioned by rotation of said handle to urge said assembly and thereby said gripping jaw toward said jaw closing position and the tension released by reverse rotation of said handle to release said assembly and thereby said gripping jaw to move to said jaw open position, said cam link means being connected to be shifted by movements of said handle, said cam link means cooperating with said control link through said spring means to bias said control link to said jaw closing position or release said assembly to said jaw open position.

2. A lifting clamp as recited in claim 1 wherein said spring means is provided by a coil spring coaxial with the pivotal mounting of said control link.

3. A lifting clamp as recited in claim 2 wherein said control link is in the form of a plate member provided with a contoured cam surface formed on a peripheral segment thereof, and said cam link means includes an arm carrying cam follower means in engagement with said cam surface to provide positive limit stops acting to block movement of said control link when said handle is shifted to its operating extremes.

4. A lifting clamp as recited in claim 3 wherein said contoured cam surface is generally U-shaped and faces outwardly of the pivotal mounting of said control link.

5. A lifting clamp as recited in claim 3 wherein said cam follower means and said cam surface interengagement retains said control link in jaw open position at one operating extreme of handle shift while limited opening movement of the jaws from jaw closing position is allowed in the other extreme of handle shift.

6. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw mounted for opening and closing movements relative to an adjustable jaw, said adjustable jaw being mounted on wedge means slidable along inclined guide track means disposed between said side plates and located on the opposite side of said clamp body slot from said gripping jaw;

a shackle mounted in said clamp body and adapted for connection to a lifting force;

a linkage assembly in said body coupling said shackle to said gripping jaw to control movements of said gripping jaw between a jaw closing position and a jaw open position;

screw means rotatably mounted between said side plates and threadably engaged with said wedge means;

a manual adjusting knob connected to said screw means whereby the spacial distance between said opposed jaws can be varied by manually turning said knob to adjust said wedge means along said track means for the clamp to accommodate the particular size plate to be lifted; and one of said wedge means and said guide track means having plate size identifying markings spaced longitudinally therealong and the other said means carrying pointer means associated with said spaced markings whereby the adjusted spacial distance between said opposed jaws to handle a particular size plate to be lifted is determinable by an operator visually observing the relative position of said markings to said pointer means.

7. A lifting clamp as recited in claim 6 wherein said wedge means displays said plate size identifying markings, and said guide track means carries said pointer means and is formed with an observation window exposing said markings for visual observation exteriorly of said clamp body through said window.

8. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link connected to move said gripping jaw through said opening and closing movements, and a control link pivoted to said side plates with first and second connecting means coupling said control link to said shackle and to said swing link, respectively;

locking means having a manually operated handle pivotally mounted on said clamp body and spring means between said side plates connected to act on said linkage assembly, said spring means being tensioned by rotation of said handle to urge said assembly and thereby said gripping jaw toward said jaw closing position and the tension released by reverse rotation of said handle to release said assembly and thereby said gripping jaw to move to said jaw open position, said locking means including cam link means connected to be shifted by movements of said handle, said cam link means cooperating with said control link through said spring means to bias said control link to said jaw closing position or release said assembly to said jaw open position; and said swing link being pivoted to said clamp body adjacent one end thereof and said gripping jaw being pivotally mounted on said swing link intermediate the ends of said swing link.

9. A lifting clamp as recited in claim 8 wherein said second connecting means comprises control pin means carried by said control link and said swing link has a slot formed in the end opposite said one end with said pin means and said slot guidingly interengaging.

10. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link connected to move said gripping jaw through said opening and closing movements, and a control link pivoted to said side plates with first and second connecting means coupling said control link to said shackle and to said swing link, respectively;

locking means having a manually operated handle pivotally mounted on said clamp body and spring means between said side plates connected to act on said linkage assembly, said spring means being tensioned by rotation of said handle to urge said assembly and thereby said gripping jaw toward said jaw closing position and the tension released by reverse rotation of said handle to release said assembly and thereby said gripping jaw to move to said jaw open position, said locking means including cam link means connected to be shifted by movements of said handle, said cam link means cooperating with said control link through said spring means to bias said control link to said jaw closing position or release said assembly to said jaw open position;

said gripping jaw being pivotally carried on said swing link, said first connecting means includes a coupling link pivotally connected at its opposite ends to said shackle and said control link, respectively, said second connecting means comprises control pin means carried by said control link, and said swing link has a slot in one end with said pin means and said slot guidingly interengaging.

11. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link connected to move said gripping jaw through said opening and closing movements, and a control link pivoted to said side plates with first and second connecting means coupling said control link to said shackle and to said swing link, respectively;

locking means having a manually operated handle pivotally mounted on said clamp body and spring means between said side plates connected to act on said linkage assembly, said spring means being tensioned by rotation of said handle to urge said assembly and thereby said gripping jaw toward said jaw closing position and the tension released by reverse rotation of said handle to release said assembly and thereby said gripping jaw to move to said jaw open position, said locking means including cam link means connected to be shifted by movements of said handle, said cam link means cooperating with said assembly through said spring means to bias said assembly to said jaw closing position or release said assembly to said jaw open position; and said gripping jaw having visually observable indicia on a surface thereof, and said gripping jaw exposes said indicia adjacent an edge of said clamp body slot when said gripping jaw is in jaw closing position whereby an operator can visually determine the clamp being in safe operating condition.

12. A lifting clamp as recited in claim 11 wherein said indicia include at least two contrasting markings which are exposed when said gripping jaw is in jaw closing position in the absence of an article to be lifted disposed between said opposed jaws.

13. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link connected to move said gripping jaw through said opening and closing movements, and a control link pivoted to said side plates with first and second connecting means coupling said control link to said shackle and to said swing link, respectively;

locking means having a manually operated handle pivotally mounted on said clamp body and spring means between said side plates connected to act on said linkage assembly, said spring means being tensioned by rotation of said handle to urge said assembly and thereby said gripping jaw toward said jaw closing position and the tension released by reverse rotation of said handle to release said assembly and thereby said gripping jaw to move to said jaw open position, said locking means including cam link means connected to be shifted by movements of said handle, said cam link means cooperating with said assembly through said spring means to bias said assembly to said jaw closing position or release said assembly to said jaw open position; and said other jaw being an adjustable jaw, said adjustable jaw being mounted on wedge means slidable along inclined guide track means disposed between said side plates and located on the opposite side of said clamp body slot from said gripping jaw, said wedge means being engaged by screw means restrained from axial movement and provided with a manual adjusting knob whereby the spacial distance between said opposed jaws can be varied by manually turning said knob to adjust said wedge means along said track means for the clamp to accommodate the particular size plate to be lifted, said wedge means having plate size identifying markings spaced longitudinally therealong, and said guide track means being formed with an observation window exposing said markings for visual observation exteriorly of said clamp body whereby the adjusted spacial distance between said opposed jaws to handle a particular size plate to be lifted is determinable by an operator visually observing said markings through said window.

14. A lifting clamp for articles such as metal plates comprising:

a clamp body including a pair of spaced side plates, said body defining a slot through said side plates to receive an article to be lifted;

a pair of opposed jaws mounted on opposite sides of said slot, one of said jaws being a gripping jaw pivotally mounted for opening and closing movements relative to the other jaw;

a shackle mounted for guided movement in said clamp body and adapted for connection to a lifting force;

a linkage assembly in said body coupling said shackle to said gripping jaw to control movements of said gripping jaw between a jaw closing position and a jaw open position, said assembly including a swing link connected to move said gripping jaw through said opening and closing movements, and a control link pivoted to said side plates with first and second connecting means coupling said control link to said shackle and to said swing link, respectively;

locking means having a manually operated handle pivotally mounted on said clamp body and spring means between said side plates connected to act on said linkage assembly, said spring means being tensioned by rotation of said handle to urge said assembly and thereby said gripping jaw toward said jaw closing position and the tension released by reverse rotation of said handle to release said assembly and thereby said gripping jaw to move to said jaw open position, said locking means including cam link means connected to be shifted by movements of said handle, said cam link means cooperating with said assembly through said spring means to bias said assembly to said jaw position or release said assembly to said jaw open position; and said other jaw being an adjustable jaw, said adjustable jaw being mounted on wedge means slidable along inclined guide track means disposed between said side plates and located on the opposite side of said clamp body slot from said gripping jaw, said wedge means being engaged by screw means restrained from axial movement and provided with a manual adjusting knob whereby the spacial distance between said opposed jaws can be varied by manually turning said knob to adjust said wedge means along said track means for the clamp to accommodate the particular size plate to be lifted, one of said wedge means and said guide track means having plate size identifying markings spaced longitudinally therealong and the other said means carrying pointer means associated with said spaced markings whereby the adjusted spacial distance between said opposed jaws to handle a particular size plate to be lifted is determinable by an operator visually observing the relative positions of said markings and said pointer means.

* * * * *